United States Patent [19]

Grado

[11] 4,031,336

[45] * June 21, 1977

[54] ELECTROMAGNETIC PICKUP WITH MAGNETIC GAP DISPLACEMENT GENERATOR

[76] Inventor: Joseph F. Grado, 4614 Seventh Ave., Brooklyn, N.Y. 11220

[ * ] Notice: The portion of the term of this patent subsequent to Apr. 29, 1992, has been disclaimed.

[22] Filed: Feb. 10, 1975

[21] Appl. No.: 548,698

[52] U.S. Cl. ..... 179/100.41 K; 179/100.41 Z; 274/37

[51] Int. Cl.[2] ..... H04R 11/12

[58] Field of Search ..... 179/100.41 J, 100.41 K, 179/100.41 M, 100.41 Z, 100.41 D; 274/37

[56] References Cited

UNITED STATES PATENTS

| | | | |
|---|---|---|---|
| 3,546,399 | 12/1970 | Stanton | 179/100.41 K |
| 3,683,128 | 8/1972 | Grado | 179/100.41 K |
| 3,694,586 | 9/1972 | Grado | 179/100.41 Z |
| 3,700,829 | 10/1972 | Anneberg | 179/100.41 Z |
| 3,763,335 | 10/1973 | Morita | 179/100.41 K |
| 3,881,073 | 4/1975 | Grado | 179/100.41 Z |

*Primary Examiner*—Bernard Konick
*Assistant Examiner*—Alan Faber

[57] ABSTRACT

An electro-magnetic cartridge for the reproduction of quadraphonic, stereophonic and/or monaural sound recordings has a balanced magnetic and electrical structure including a replaceable stylus lever-generator assembly which has front and rear pole piece extensions forming terminations of the opposite polarities of the magnetic structure cooperatively positioned to form first and second pairs of operating gaps with the generator extending at least partially into the operating gaps.

11 Claims, 6 Drawing Figures

ELECTROMAGNETIC PICKUP WITH MAGNETIC GAP DISPLACEMENT GENERATOR

The present invention relates to electro-magnetic cartridges for the reproduction of monaural, stereophonic and/or quadraphonic sound recordings, etc. and in particular to an improved replaceable module for such an electro-magnetic cartridge.

In a typical cartridge, a housing supports an appropriate magnetic structure including first and second pairs of coil, with each coil pair being connected in series. A stylus lever-generator assembly is also mounted on the cartridge housing and includes a cantilever-supported stylus lever having the requisite compliance such that the stylus thereof may track the usual 45°–45° groove of a phonograph record disc. Operatively connected to the stylus lever is a generator which is disposed in the cartridge proximate the magnetic gaps defined by a permanent magnet and pole pieces of the magnetic structure. Motion of the stylus in the record groove produces related motion in the generator which causes a signal to be induced in the coil pairs. These signals are then processed to provide a reproduction of the signals formed in the record groove.

In my co-pending application Ser. No. 414,950, filed Nov. 12, 1973, now U.S. Pat. No. 3,881,073, there is disclosed an electro-magnetic cartridge having a replaceable stylus lever-generator assembly. The assembly structure contains both front and rear pole piece extensions which when the module is inserted in the cartridge form extensions of the opposite polarities of the magnetic structure of the cartridge and define a pair of operating gaps between them. Also mounted in the assembly is a stylus lever-generator assembly. The stylus lever extends generally parallel to the length dimension of the operating gap. Disposed on the stylus lever is a generator which is operatively positioned in the gap between the front and rear pole piece extensions but outside the operating gaps or magnetic flux path between them. While this magnetic cartridge was an improvement over prior cartridges, some problems remain to be solved to provide an optimum cartridge design.

One of these problems, particularly for cartridges for quadraphonic recording, is to increase the frequency response and bandwidth of the cartridge. One approach to this problem is to decrease the mass of the generating system, especially the generator itself. However, decreasing the mass of the generator reduces the amount of iron present in the magnetic flux path of the cartridge which decreases the voltage sensitivity of the cartridge.

Other problems are present when a module having a stylus lever and generator is designed to be removably mounted in the electrical and magnetic structure of the cartridge, since the module is inserted into an existing magnetic gap of the cartridge and precision and control of the tolerances between the magnetic circuit of the cartridge and the generator in the module are difficult to achieve resulting in variations in stylus lever compliance, variations in voltage outputs in the channels of the reproduction system and voltage variations between the channels. In addition, the air gap between the generator and the magnetic structure tends to be relatively large making electro-magnetic cartridges with replaceable modules relatively less sensitive than cartridges without replaceable modules.

Accordingly, it is an object of the present invention to provide an improved electro-magnetic cartridge for the reproduction of sound recordings which obviates one or more of the foregoing problems.

Specifically, it is an object of the present invention to provide an electro-magnetic cartridge with a generator having a relatively low mass while still providing relatively high voltage sensitivity and freedom from uncontrolled generator movement by controlled magnetic damping.

It is a still further object of the invention to provide these improvements in a cartridge having a replaceable stylus lever-generator assembly.

Still further, it is an object of this invention to provide these improvements in an electro-magnetic cartridge which can be manufactured on a mass production basis at a relatively low unit cost.

In accordance with an illustrative embodiment of in invention, there is provided an electro-magnetic cartridge having a support, a magnetic structure mounted on the support including a front magnetic member, a rear magnetic member magnetically coupled to opposite poles of a permanent magnet. The magnetic structure also includes first and second pairs of rear pole piece extensions magnetically coupled to rear magnetic members, respectively and a front magnetic extension which are cooperatively arranged to form first and second pairs of operating gaps; the magnetic flux path in the magnetic structure including said operating gaps. Also disposed in the cartridge is a stylus lever-generator assembly. The stylus lever extends generally parallel to the length dimension of the operating gap and terminates in a stylus which tracks the record grooves. Operatively disposed on the stylus lever is a generator which extends at least partially into the magnetic flux path in the operating gaps. Advantageously, the cartridge includes a carrier removably mounted between the front magnetic member and the rear pole pieces. Mounted on the carrier are the rear pole piece extensions, the front magnetic extension and the stylus lever-generator assembly so that the carrier forms a replaceable module for the cartridge.

Use of both front and rear magnetic extensions reduces the magnetic flux path for the cartridge and concentrates the magnetic flux in the operating gaps. By positioning the generator at least partially in the operating gaps a greater portion of the magnetic flux flows through the generator thereby increasing the voltage sensitivity of the cartridge. In addition, the magnetic flux flowing through the generator also damps the movement of the generator to control unwanted generator movement thereby reducing distortion in the reproduction system.

Still other objects, features and advantages of the present invention will be understood by reference to the following detailed description of a presently preferred but nonetheless illustrative embodiment of the invention, when taken in conjunction with the accompanying drawings wherein.

Figure 2:
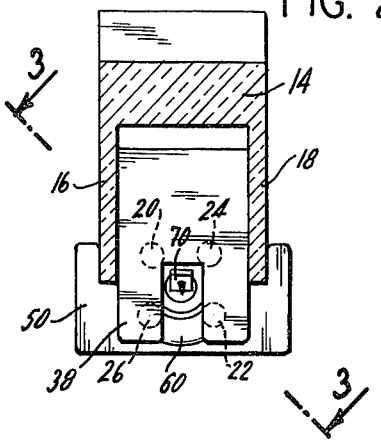
FIG. 2 is a side elevation view of the electro-magnetic cartridge of FIG. 1.

Referring now specifically to the drawings, and in particular to FIGS. 1–4, there is shown an improved electro-magnetic cartridge or pickup for monaural, stereophonic and/or quadraphonic reproduction, etc. of sound recordings, generally designated by reference numeral 10, which is mounted within an appropriate housing H, which is in turn removably mounted on the tone arm of a turntable or record player. Housing H includes top wall 12, front wall 14, and spaced side walls 16, 18, which define a downwardly opening cartridge-receiving chamber C into which the cartridge 10 is inserted.

Cartridge 10 includes, a balanced magnetic structure M including four rear pole pieces, 20, 22, 24, 26, whose forwardly directed faces terminate or lie in a common plane P. Pole pieces 20, 22 provide a first diametrically opposed pair having their longitudinal center lines in a substantially common plane at 45° to the horizontal (see FIG. 3); and pole pieces 24, 26 provide a second diametrically opposed pair in which the pole pieces have their longitudinal center lines in a substantially common second plane at 45° to the horizontal and at right angles to the first plane. A first pair of coils 28, 30 is mounted on the first pair of pole pieces 20, 22 and connected in voltage adding and hum canceling relation to each other; and a similar pair of coils 32, 34 are mounted on the second pair of pole pieces 24, 26 with the coils likewise being connected in voltage adding and hum canceling relation to each other. Typically, as is well known in the art, each of the coils includes a coil bobbin fabricated of a non-ferrous material and a coil proper wound such that the opposing pairs of coils are of substantially identical configuration to avoid introducing any electrical imbalance in the coil arrangements and symmetry.

The balanced magnetic structure also includes a rear magnetic plate 36, a front magnetic plate 38 disposed in spaced parallel relation to the rear plate 38 and a permanent magnet 40, magnetically interconnected therebetween. The pole pieces are supported on the rear magnetic plate 36 by non-ferrous sleeves 42 which provide compensating gaps through which the rear pole pieces are magnetically coupled to the rear magnetic plate. As explained in greater detail in U.S. Pat. No. 3,694,586 of Sept. 26, 1972, the compensating gaps are adjustable to prevent stray fields from generating hum producing voltages in the cartridge. Cylindrical ferrous ring 44 surrounding the coils provides further hum cancellation.

Figure 1:
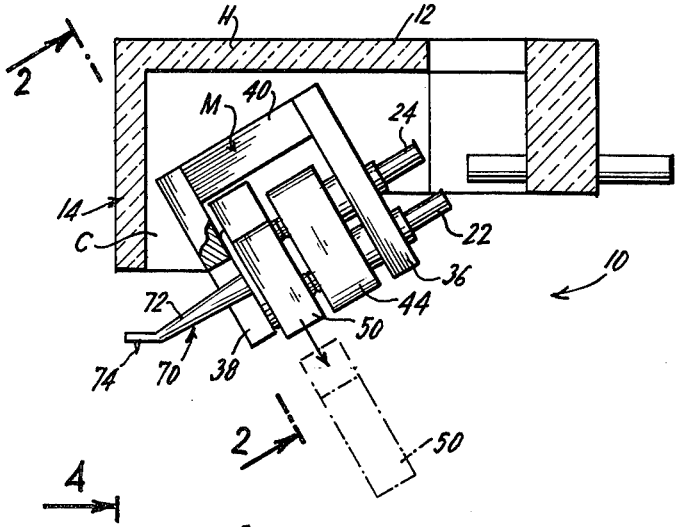
FIG. 1 is a longitudinal sectional view of a typical electro-magnetic cartridge embodying features of the present invention, shown with the balanced magnetic structure partially removed from the cartridge housing, a dotted line showing a removed position of the stylus lever-generator assembly.
Figure 3:
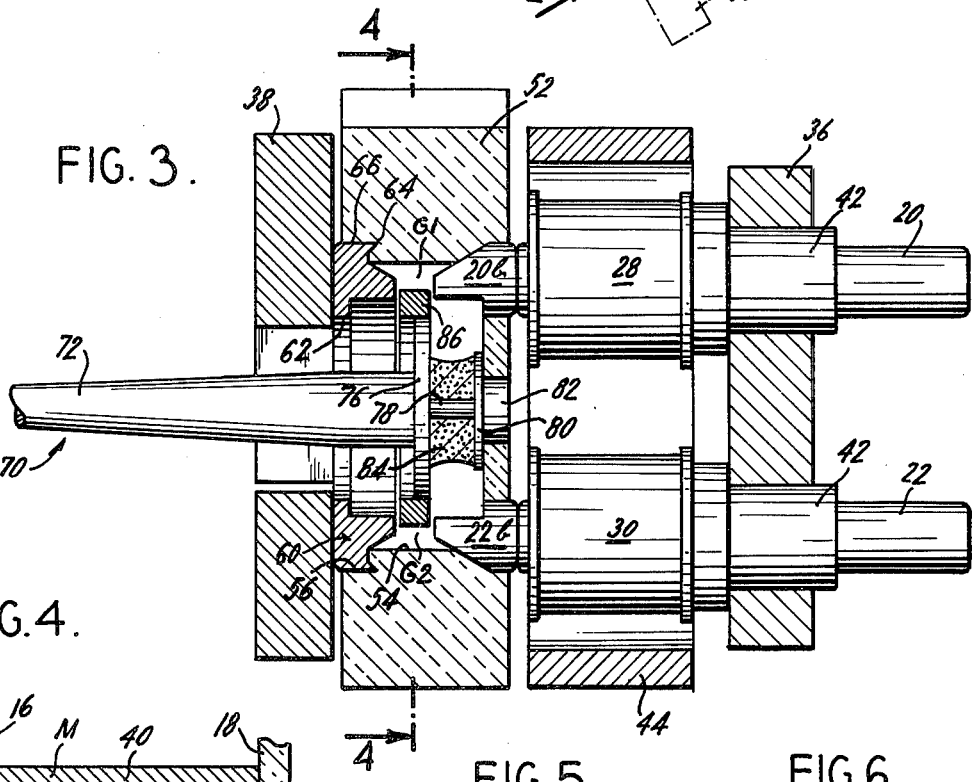
FIG. 3 is a sectional view on an enlarged scale, taken substantially at 45° to the horizontal and along the lines 3—3 of FIG. 2 and looking in the direction of the arrows.
Figure 4:
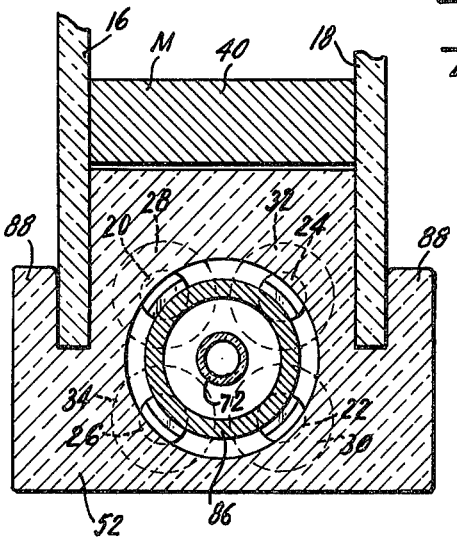
FIG. 4 is a sectional view taken along the lines 4—4 of FIG. 3 looking in the direction of the arrows.

Disposed in the magnetic path afforded by the magnetic structure M is a replaceable module, generally designated by the reference numeral 50, which is removably mounted in a downwardly opening socket or cavity provided intermediate the rear face of the front magnetic plate 38 and the adjacent front faces of the rear pole pieces in common plane P (see FIGS. 1 and 3). Module 52 includes a carrier 52 fabricated of non-ferrous material.

Positioned symmetrically on carrier 52 are rear pole piece extensions **20*b*, 22*b*, and 24*b*, 26*b*** (not shown). The rear pole piece extensions are adapted to be respectively magnetically coupled and in contact with the rear pole pieces and are formed of a magnetic material having generally cylindrical rear portions which terminate in rear faces having a diameter substantially equal to the diameter of the front faces of the rear pole pieces, and tapered forward portions having radially outer surfaces tapered radially inward from the rear towards the front of the pole piece extensions terminating in front faces lying in a substantially common plane.

Module 52 is formed with central cavity 54 having a shoulder or seat 56 opening toward the front magnetic plate 38 of the magnetic structure M adapted to receive front magnetic extension assembly 60. The front magnetic extension assembly is adapted to be magnetically coupled and in contact with the rear face of the front magnetic member 38 and is formed of magnetic material with an annular front portion having an inwardly extending shoulder 62 and a rearwardly directed mating ridge 64 adapted to press into seat 56 to provide support for assembly 60. Further support is provided by surface 66 which presses into the outer surfaces of the seat. Extending rearwardly is a tapered ring member 68 terminating in a rear face which lies in a substantially common plane. The cooperation between the rear face of the front magnetic extension assembly and the front faces of the rear pole pieces define first and second pairs of operating gaps, $G_1$, $G_2$ (see FIG. 3) and $C_3$, $G_4$ (not shown). Alternatively, the front magnetic assembly could include four individual front pole piece extensions similar to the rear pole piece extensions and arranged to form operating gaps $G_1$, $G_2$ and $G_3$, $G_4$. By providing the rear pole piece extensions and the front magnetic extension, the overall length of the operating gaps are reduced thus producing increased flux density in the gap. Further, tapering the front and rear extensions confines the magnetic flux to a relatively small area and minimizes fringing.

Mounted on the non-ferrous carrier 52 is the stylus lever-generator assembly generally designated by reference numeral 70 which includes stylus lever 72 extending generally parallel to the length dimension of the operating gaps and having the usual stylus 74 mounted approximate its forward end and terminating at its rearward end in flange 76. A suspension system for the stylus lever-generator assembly includes reduced diameter shaft 78 extending axially from the rearward end of the stylus lever and connected to flange 80 which, in turn, is anchored to base support 82. Interposed between the rearward face of flange 76 and the forward face of flange 80 and surrounding shaft 78 is an elastomeric member 84 which is in axial compression to preload the suspension system as described in greater detail in U.S. Pat. No. 3,683,128 of Aug. 8, 1972 in particular the embodiment shown in FIG. 7.

Operatively coupled to flange 76 of stylus lever 72 is an annular generator 86 which is symmetrically disposed with respect to the operating gaps. The generator is constructed of a magnetic material which extends at least partially into the flux path of the operating gaps and moves in response to the stylus lever motion as the stylus tracks a record groove to modify the flux path through the operating gaps as will be explained in greater detail below.

The removable mounting of module 50 is accomplished by appropriately sizing carrier 52 and rear pole piece extensions and the front magnetic extension in relation to the cavity, rear pole pieces and the front magnetic plate so that the insertions of the module into the cavity result in generally constant pressure between the module and the front of the rear pole pieces and the rear of the front magnetic plate; such contact being necessary to maintain a zero magnetic coupling gap between the replaceable module and the fixed magnetic assembly. Additional support for the module can be obtained by forming carrier 52 with surfaces which will interengage with housing H, as for example, guiding extensions 88 which engage the lower portion of sidewalls 16, 18. When the assembly is in its operating position, the magnetic extensions are physically and magnetically coupled to the front magnetic plate and the rear pole pieces, completing a magnetic circuit between opposite polarity faces of the pole piece extensions and front magnetic extensions via the rear pole pieces which are magnetically connected through the compensating gaps provided by sleeve 42 to rear magnetic plate 36 which, in turn, is magnetically connected to front magnetic plate 38 by permanent magnet 40.

A typical sequence of operation will now be described to facilitate a more thorough understanding of the present invention.

Figure 5:
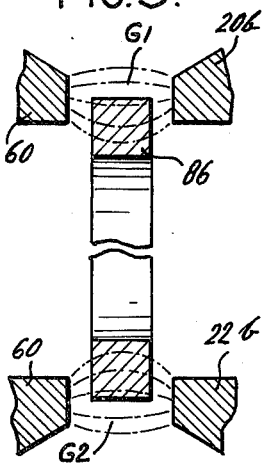
FIG. 5 is a diagrammatic and schematic representation of the operating gaps and generator intended to aid in the understanding of the operation of the cartridge.

Normally, generator 86 is disposed at least partially within the operating gaps and within the flux paths formed between the magnetic extensions (FIG. 5). As stylus 74 tracks a record groove, it will produce corresponding motion of the generator about a pivot point rearward of the generator. The generator inherently produces a vector resolution of the stylus motion so that one pair of operating gaps will be related to one side of the record groove (either for stereophonic or quadraphonic pickup) and the other pair of operating gaps will be related to the other side of the record groove.

Figure 6:
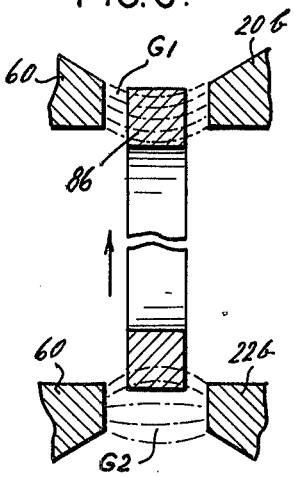
FIG. 6 is a view similar to FIG. 5 but showing the generator in a typical position during operation.

Considering any particular stylus excursion (FIG. 6), the generator moves generally perpendicular to the operating gap (generally following the direction of the arrow) thereby introducing more magnetic material into gap G1; effectively shortening the gap by increasing the flux density; and inducing a voltage in coil 28. The flux through the companion gap G2 is reduced by an amount substantially equal to the increase in the flux density and the gap G1 as the generator moves a corresponding distance out of gap G2. Since, in this arrangement of the generator with respect to the operating gaps, the generator is always in the magnetic fields which exist between the four opposite polarity faces of the rear pole piece extensions and front magnetic extensions, unwanted and uncontrolled movement of the generator is damped out by the magnetic field. Also, a smaller excursion of the generator will cut across a greater number of lines of magnetic flux thereby inducing a larger voltage in the coils for a particular generator excursion. This is particularly true with the arrangement of magnetic extensions which serve to shorten the operating gap length and concentrate the flux in the gap. Furthermore, since both polarities of the magnetic structure are present in the replaceable module, the cooperative arrangement between the generator and operating gaps can be accurately controlled and existing cartridges can be upgraded in performance with replaceable modules of this new design.

While this invention has been described in some detail, this description does not limit the invention for it will be understood by those skilled in the art that variations and modifications may be made without departing from the spirit thereof or the scope of the following claims.

What I claim is:

1. A replaceable module for an electro-magnetic cartridge comprising a carrier, first and second magnetic members mounted in opposing relationship on said carrier and cooperatively positioned to define first and second operating gaps, a stylus lever operatively mounted on said carrier and extending generally parallel to the length dimension of said operating gaps, a generator operatively mounted on said stylus lever and extending at least partially into said operating gaps between said first and second magnetic members, said generator mounted for movement substantially perpendicular to said operating gaps in response to movement of said stylus lever.

2. The replaceable module of claim 1 wherein said magnetic members have a cross-sectional area which is substantially less at one end then at the other end, said operating gaps being defined between the smaller ends of said magnetic member.

3. The replaceable module of claim 2 wherein said first and second pairs of magnetic members include first and second pairs of magnetic extension members adapted to be magnetically coupled into the magnetic circuit of said electro-magnetic cartridge.

4. An electro-magnetic cartridge comprising a support, a magnetic structure mounted to said support including a permanent magnet, a front magnetic member coupled to said permanent magnet including front magnetic extension having a rear face disposed in a substantially common first plane, first and second pairs of rear pole pieces mounted in cooperative relationship with said front magnetic extensions, the front faces of said rear pole pieces disposed in a substantially common second plane substantially parallel to said first plane forming first and second pairs of operating gaps between said front magnetic extension and rear pole pieces, a stylus lever-generator assembly mounted on said support, said stylus lever extending generally parallel to the length dimension of said operating gap, said generator operatively disposed on said stylus lever and extending at least partially into said operating gaps between said front magnetic extension and the front faces of said rear pole pieces, said stylus lever being operative in response to tracking of a record groove to move said generator relative to said operating gaps.

5. In an electro-magnetic cartridge having a support, a magnetic structure including a permanent magnet, a front magnetic member coupled to said permanent magnet, and having a rear face disposed in a first plane defining one side of a module receiving cavity and first and second pairs of rear pole pieces mounted on said support and having front faces disposed in a common second plane substantially parallel to said first plane and defining the second side of said module receiving cavity, a replaceable stylus lever-generator assembly dimensioned to be removably mounted in said cavity including a carrier, a first magnetic extension means mounted on said carrier adapted to be magnetically coupled to the front magnetic member, said first magnetic extension means having a rear face disposed in a plane, second magnetic extension member mounted on said carrier, said second magnetic extension member including first and second pairs of rear pole piece extensions adapted to be magnetically coupled to said rear pole pieces and having pole faces disposed in a common second plane substantially parallel to said first plane and cooperating with said front magnetic extension means to define a pair of operating gaps, a stylus lever-generator assembly mounted on said module including a stylus lever extending generally parallel to the length dimension of said operating gap and a generator operatively disposed on said stylus lever extending at least partially in said operating gaps between said front magnetic extension means and said first and second pairs of rear pole piece extensions, said stylus lever being operative to track said record groove to move the generator relative to said operating gaps.

6. An electro-magnetic cartridge for the reproduction of sound recordings comprising a support, a balanced magnetic structure mounted on said support including a front magnetic member, a rear magnetic member and a permanent magnet magnetically coupled between said front and rear magnetic members, a pair of rear pole pieces magnetically coupled to said rear magnetic member, rear pole piece extensions magnetically coupled to said rear pole pieces having front faces lying in a substantially common plane defining one side of an operatinng gap, a pair of front pole piece extensions magnetically coupled to said front magnetic member and having rear pole faces lying in a substantially common plane cooperatively positioned with respect to the front faces of said rear pole piece extensions to define the opposite side of said operating gap, said magnetic structure having a magnetic flux path including said operating gap, a stylus lever operatively mounted on said support and extending generally parallel to the length dimension of said operating gap including a stylus mounted to engage a record groove, a generator coupled to the stylus lever and cooperatively positioned to extend at least partially into the magnetic flux path between said front and rear pole piece extensions when the stylus is not in engagement with the record groove said generator moving generally perpendicular to the magnetic flux path in said operating gap in response to motion of the stylus lever as the stylus tracks a record groove.

7. The electro-magnetic cartride of claim 6 further including a carrier adapted to be removably mounted in said cartridge between said front magnetic member and said rear pole pieces, said front and rear pole piece extensions, said stylus lever and said generator being mounted on said carrier so that said carrier forms a replaceable module for said cartridge.

8. An electro-magnetic cartridge comprising a support, a magnetic structure mounted to said support including a permanent magnet, a front magnetic member coupled to said permanent magnet including first and second pairs of front pole piece extensions having rear pole faces disposed in a substantially common first plane, first and second pairs of rear pole pieces mounted in cooperative relationship with said front pole piece extensions, the front faces of said rear pole pieces disposed in a substantially common second plane substantially parallel to said first plane forming first and second pairs of operating gaps between said first and second pair of front pole piece extensions and rear pole pieces, a stylus lever-generator assembly mounted on said support, said stylus lever extending generally parallel to the length dimension of said operating gap, said generator operatively disposed on said stylus lever and extending at least partially into said operating gaps between said first and second pairs of front pole piece extensions and the front faces of said rear pole pieces, said stylus lever being operative in response to tracking of a record groove to move said generator relative to said operating gaps.

9. An electro-magnetic cartridge comprising a support, a magnetic structure mounted to said support including a permanent magnet, a front magnetic member coupled to said permanent magnet, first and second pairs of rear pole pieces mounted on said support in cooperative relationship with said front magnetic member to provide a magnetic flux path between said rear pole pieces and said front magnetic member, a stylus-lever generator assembly mounted on said support, said stylus lever extending generally parallel to the length dimension of said operating gap, said generator operatively disposed on said stylus lever and extending at least partially into said operating gap between said front magnetic member and said first and second rear pole pieces said stylus lever being operative in response to tracking of a record groove to move said generator substantially perpendicular to said magnetic flux path.

10. In an electro-magnetic cartridge having a magnetic structure including a permanent magnet, a front magnetic member coupled to said permanent magnet, and having a rear face disposed in a first plane defining one side of a module receiving cavity and first and second pairs of rear pole pieces mounted on said support and having front faces disposed in a common second plan substantially parallel to said first plane and defining the second side of said module receiving cavity, said front magnetic member and rear pole pieces defining operating gaps there between, a replaceable stylus lever-generator module dimensioned to be removably mounted in said cavity including a carrier, a stylus lever generator assembly mounted on said module including a stylus lever extending generally parallel to the length dimension of said operating gaps and a generator operatively disposed on said stylus lever extending at least partially in said operating gaps between said front magnetic member and said rear pole piece and stylus lever being operative to track said record groove to move the generator substantially perpendicular to the length dimension of said operating gaps.

11. An electro-magnetic cartridge for the reproduction of sound recordings comprising a support, a balanced magnetic structure mounted on said support including a front magnetic member defining one side of an operating gap, a rear magnetic member and a permanent magnet magnetically coupled between said front and rear magnetic members, a pair of rear pole pieces magnetically coupled to said rear magnetic member having front faces lying in a substantially common plane defining the opposite side of the operating gap, said magnetic structure having a magnetic flux path including said operating gap, a stylus lever operatively mounted on said support and extending generally parallel to the length dimension of said operating gap including a stylus mounted to engage a record groove, a generator coupled to the stylus lever and cooperatively positioned to extend at least partially into the magnetic flux path the operating gap between the front magnetic member and said pair of rear pole pieces when the stylus is not in engagement with the record groove, said generator moving substantially perpendicular to the magnetic flux path in said operating gap in response to motion of the stylus lever as the stylus tracks a record groove.

* * * * *